US008210504B1

(12) United States Patent
Skornickel

(10) Patent No.: US 8,210,504 B1
(45) Date of Patent: Jul. 3, 2012

(54) FENCE RAIL HANGER BRACKET

(76) Inventor: Anthony J. Skornickel, Pittsburgh, PA (US)

( * ) Notice: Subject to any disclaimer, the term of this patent is extended or adjusted under 35 U.S.C. 154(b) by 0 days.

(21) Appl. No.: 13/068,749

(22) Filed: May 19, 2011

(51) Int. Cl.
*E04H 17/00* (2006.01)

(52) U.S. Cl. ..... 256/65.01; 256/67; 256/68; 256/65.04; 256/65.06; 256/73; 256/DIG. 4

(58) Field of Classification Search ..... 256/65.01, 256/67, 68, 65.02–65.07, 73, DIG. 2, DIG. 4, 256/DIG. 6; 49/381, 385, 394, 397–399
See application file for complete search history.

(56) References Cited

U.S. PATENT DOCUMENTS

| | | | | | |
|---|---|---|---|---|---|
| 908,394 | A | * | 12/1908 | Corbeille | 16/392 |
| 1,009,251 | A | * | 11/1911 | Lippincott | 16/392 |
| 1,359,734 | A | * | 11/1920 | Parsons | 16/392 |
| 1,872,077 | A | * | 8/1932 | Forbes | 49/398 |
| 1,950,874 | A | * | 3/1934 | Atwood | 49/398 |
| 2,105,705 | A | * | 1/1938 | Spathelf | 49/398 |
| 2,323,870 | A | * | 7/1943 | Kaliska | 16/392 |
| 2,808,610 | A | * | 10/1957 | Minor | 16/365 |
| 3,075,235 | A | * | 1/1963 | Albinson | 16/384 |
| 3,336,075 | A | * | 8/1967 | Wilson | 49/394 |
| 3,903,567 | A | * | 9/1975 | Suska | 49/381 |
| 4,265,423 | A | * | 5/1981 | Vecchiarelli | 248/264 |
| 4,580,753 | A | * | 4/1986 | Hennequin | 248/264 |
| 4,607,677 | A | * | 8/1986 | Comeau | 248/264 |
| 5,265,837 | A | * | 11/1993 | Marocco | 248/264 |
| 6,382,295 | B1 | * | 5/2002 | Nicholson | 248/267 |
| 6,398,193 | B1 | | 6/2002 | DeSouza | |
| 6,543,751 | B1 | * | 4/2003 | Spruill | 256/65.04 |
| D497,533 | S | * | 10/2004 | Wegman | D8/323 |
| D497,534 | S | * | 10/2004 | Wegman | D8/323 |
| D534,053 | S | * | 12/2006 | Sozzi | D8/329 |
| 7,665,187 | B1 | * | 2/2010 | Elowsky | 16/392 |
| 2004/0195561 | A1 | | 10/2004 | Forbis | |
| 2010/0270526 | A1 | | 10/2010 | Erwin | |

* cited by examiner

*Primary Examiner* — Victor MacArthur
(74) *Attorney, Agent, or Firm* — Carothers & Carothers

(57) ABSTRACT

A bracket for attaching a fence rail end to a fence post, the bracket having two upstanding sidewalls spaced for receiving the fence rail end therebetween and a rear wall connecting and extending between the two sidewalls. The rear wall is secured to the fence post. A bottom wall is provided between the two sidewalls and defines a support surface for supporting the rail end. One of these sidewalls is hinged to the rear wall for hinging this hinged sidewall outwardly to receive a fence rail end into the bracket from the side. Apertures are provided in the sidewall for securing it to the fence rail after it is received in the bracket with fasteners. The bottom wall which supports the rail end is securable to the rear wall whereby the bracket is adaptable to selectively provide either a left hand bracket or a right hand bracket. A unitary fence rail assembly may thus be installed from the front or side as opposed to having to lower and raise the entire panel for the full height of the fence.

2 Claims, 3 Drawing Sheets

FENCE RAIL HANGER BRACKET

BACKGROUND OF THE INVENTION

The present invention relates generally to fence systems and, in particular, to mounting brackets for attaching fence rails to fence posts.

Plastic fence construction has become more prevalent in recent years as wood fences have many disadvantages, such as being relatively heavy for a given strength, splitting and breaking under impact. In addition, wood will tend to rotten decay under most conditions and must be protected either by a preservative finish using an expensive chemical treatment or else painted with an appropriate decorative finish which must be reapplied periodically. Thus, wood fencing requires continuing costs of maintenance and repair.

Such wood fencing has accordingly been replaced in many instances by plastic fencing, such as fencing constructed of polyvinyl chloride or PVC which is strong, durable, easily manufactured and requires little maintenance.

Typical fence systems include vertical posts, horizontal rails extending between the posts, and often vertical pickets, boards or panels secured to and between the rails.

Plastic fence systems molded of vinyl or other plastic have become popular because of their durability and low cost. In such fence systems, plastic or metal brackets are mounted to the post to support the rails. The brackets are usually mounted to the post by metal screws, and then metal screws are inserted through holes in the brackets and into the rails to secure the rails to the brackets. The bottom walls of the brackets initially support the weight of the rails, the side rails of the brackets hold the rails in place on the bottom walls, and the screws that secure the rails to the brackets keep the rails from being upwardly dislodged from the brackets. These screws are typically made of very high grade aluminum so that they will not corrode and stain the fencing.

Examples of such plastic fence systems may be seen in U.S. Pat. No. 6,398,193, and U.S. Patent Application Publication Nos. 2004/0195561 and 2010/0270526.

In situations wherein the fence panels running between the horizontal fence rails run up very close to the vertical posts, the entire fence panel is unitary and must be inserted and removed by vertically lowering or raising the panel from the top of the fence to the bottom rail hangers. This means that there must be no supporting rail hanger surface in the upper brackets and any intermediate brackets as the bottom rail ends are required to completely pass downwardly through the upper brackets and continue on to finally rest at the bottom of the fence structure on the floor or bottom walls of the bottom rail hanger brackets.

Accordingly, the installation and removal of large fence panels cannot be accomplished by a single individual with the prior art systems as two persons are required at each end of the fence panels to either lower them into position or fully raise them to remove the fence panels.

In this latter situation where solid fence panels are provided which extend fully between the vertical fence posts, the rail hanger brackets are molded of plastic and provided with in turned lips at their bottom side ends to provide bottom rail end hanger support walls. Since, in this situation, there can be no bottom wall in the upper and any intermediate brackets, these brackets are molded of plastic and the bottom in turned lips providing the hanger bottoms for the rails must be broken off so that all the rail ends may pass downwardly or upwardly through the upper brackets.

It is a principal object of the present invention to eliminate these disadvantages and provide fence rail hanger brackets which permit a single individual to easily install and remove large fence panel sections.

SUMMARY OF THE INVENTION

The rail end hanger bracket of the present invention is comprised of two upstanding sidewalls spaced for receiving the fence rail end therebetween, and a rear wall which connects and extends between the sidewalls and is configured, usually with apertures, to mount the brackets to the fence post. A bottom wall is provided between the two sidewalls and defines a support surface for supporting the rail ends. One of the two sidewalls is hinged to the rear wall for hinging this one sidewall outwardly so that the fence rail may be received into the bracket from the side, as opposed to being received from the top as required by the brackets of the prior art. Apertures are also provided in this hinged sidewall for securing it to the fence rail when received in the bracket with fasteners.

In addition, the bottom support or hanger wall of each bracket is removably securable to the rear wall of the bracket whereby the bracket is adaptable to selectively provide either a left hand bracket or a right hand bracket. Accordingly, the brackets of the present invention are readily adaptable to be mounted on a left hand or a right hand fence post with all of the hinged bracket sidewalls facing the same direction, whereby the hinged sidewalls may all be hinged outwardly to receive the rail ends of an entire fence panel from the side instead of having to lift the entire panel to the fence top and lowering the entire panel downwardly through consecutive brackets.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

FIGS. 3C and 3D show respectively a top and front view of the removable bottom wall portion of the bracket for the bottom fence rail hanger bracket which is securable to the rear wall of the assembly shown in FIG. 3A.

DETAILED DESCRIPTION OF THE PREFERRED EMBODIMENTS

Figure 1:
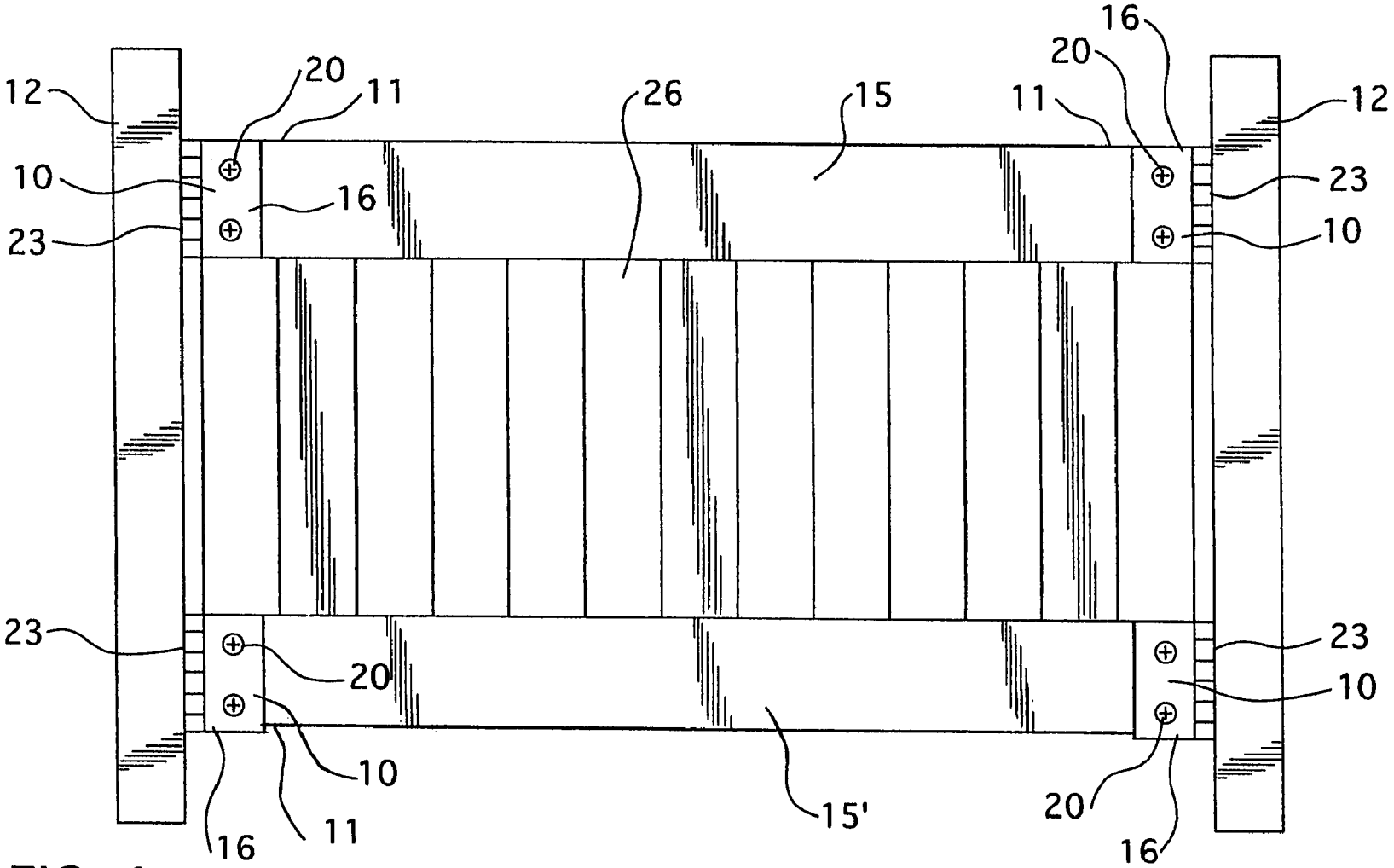
FIG. 1 is a view in side elevation of a section of plastic fence construction utilizing the fence rail end hanger brackets of the present invention.
Figure 2:
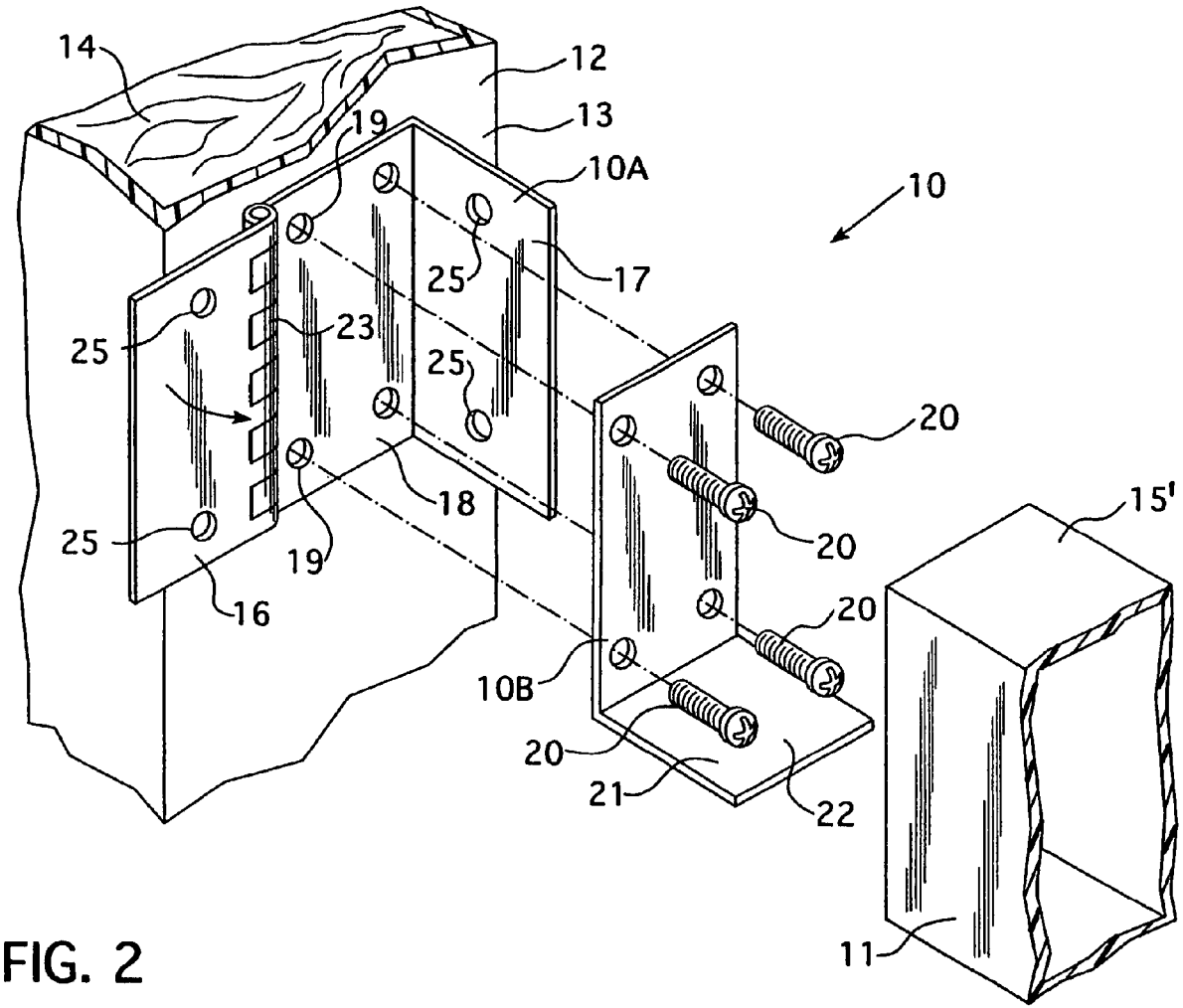
FIG. 2 is an exploded isometric view of one bottom fence rail end hanger bracket of the present invention.
Figures 3A, 3B, 3C, 3D:
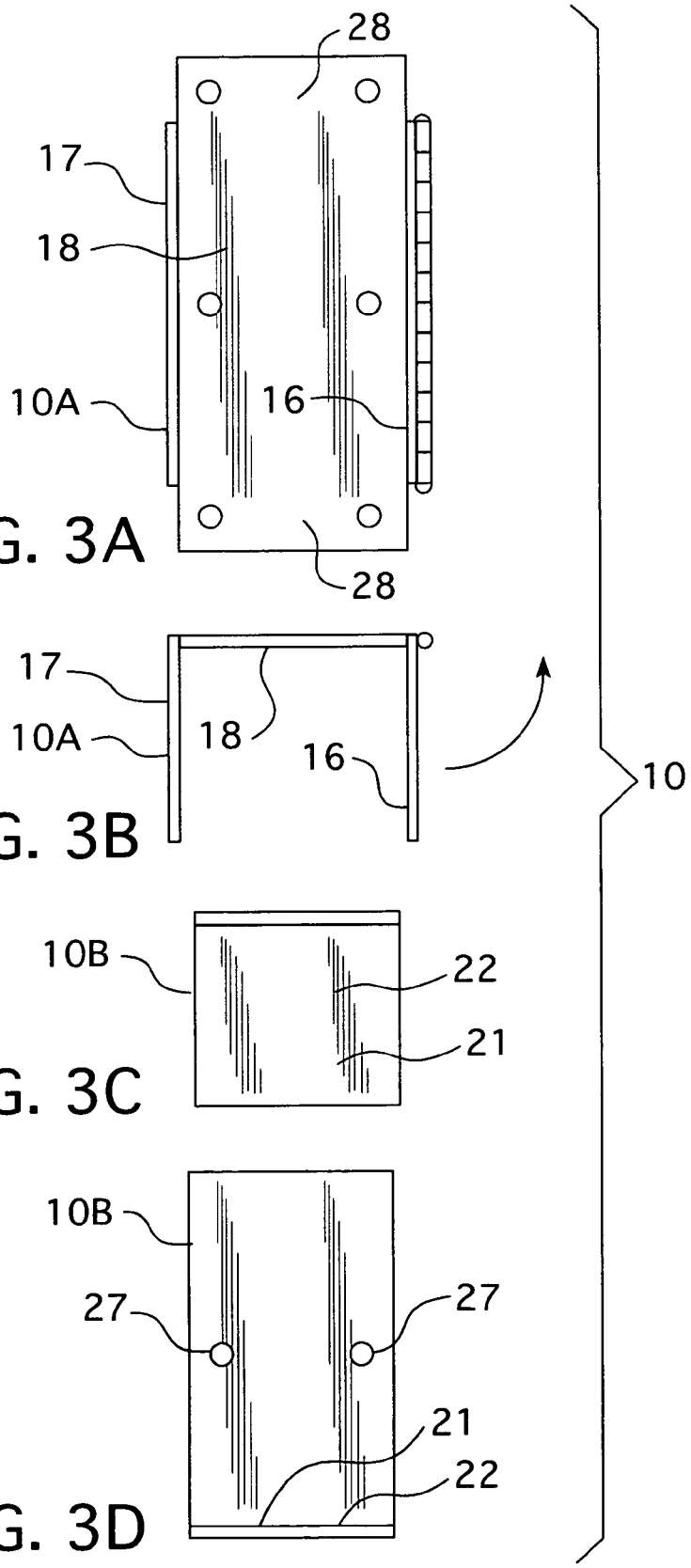
FIGS. 3A-3D illustrates an alternative embodiment of the fence rail end hanger bracket of the present invention wherein FIGS. 3A and 3B respectively show a front and top view of the bracket sidewalls and rear wall.

Referring to FIGS. 1 and 2, the rail end hanger bracket 10 of the present invention is provided for attaching a fence rail end 11 to a fence post 12. A fence post 12 consists of a plastic extruded square sleeve 13 which is slid into position over internal four by four treated wood post 14. Fence rail 15 is extruded of a suitable plastic, such as PVC, and consists of an extruded hollow rectangular tubular structure.

Bracket member 10A of bracket 10 has two upstanding sidewalls 16 and 17 which are normally spaced for receiving the fence rail end 11 therebetween as illustrated in FIG. 1. Bracket member 10A is further provided with a rear wall 18 which connects and extends between sidewalls 16 and 17 and is configured or provided with apertures 19 for mounting the rear wall 18 to post 12 with screws 20.

Bottom wall 21 for bracket 10 is provided separately by bracket member 10B and is securable to rear wall 18 by means of screws 20. Bottom wall 21 defines a hanger support surface 22 for supporting the rail end 11 of bottom rail 15' for the bottom brackets 10. Bracket member 10B is not used in the upper brackets 10.

Sidewall 16 is hinged at 23 to rear wall 18 for hinging sidewall 16 outwardly as indicated in FIG. 2 to receive the fence rail end 11 into the bracket 10 from the side past hinge 23, as opposed to from the top as required by the hanging bracket structures of the prior art.

Apertures 25 are provided in hinged sidewall 16 for securing the sidewall 16 to the fence end 11 after it is received within bracket 10 with additional screws 20.

The result is that the entire solid unitary fence panel 26 made up of top rail 15 and bottom rail 15' with fence panel boards secured therebetween may be installed between posts 12 simply by hinging all four hinged sidewall plates 16 outwardly and then horizontally placing the rail ends 11 of panel 26 into position in the respective hanger brackets 10 past the respective hinges 23 of the brackets. The hinged bracket plates 16 are then hinged closed and secured to the rail ends 11 respectively with fasteners 20. Accordingly, the entire panel 26 does not have to be lifted entirely above the fence structure shown in FIG. 1 and then lowered through the brackets as required by the prior art and one individual may thus easily install and uninstall a single large fence panel 26 without assistance.

Turning to the modification shown in FIGS. 3A-3D, the bracket member 10A is modified in that rear wall 18 is provided with upper and lower securement ear extensions 28 for securing the rear wall 18 to a post 12, and the bottom wall bracket member 10B is provided with only two apertures 27, instead of 4, for securement to a back wall 18 and post 12.

In this embodiment, it should be noted that the bracket member 10A is inverted from the member illustrated in FIG. 2 in order to provide a right hand bracket as opposed to a left hand hinging bracket as illustrated in FIG. 2. In this regard, refer to FIG. 1 which illustrates the respective left hand and right hand bracket members.

The brackets 10 are preferably constructed of metal with a protective powder coating.

I claim:

1. A bracket for attaching a fence rail end to a fence post, comprising:

two upstanding sidewalls spaced for receiving the fence rail end therebetween;

a rear wall connecting and extending between said sidewalls and configured to mount to the post, whereby said rear wall and side walls define open top and bottom ends;

one of said sidewalls hinged to the rear wall for hinging said one sidewall outwardly to receive the fence rail end into the bracket from the side;

at least one aperture in said one sidewall for securing it to the fence rail end when received in the bracket with a fastener;

a bottom wall in the open bottom open end between the two sidewalls and defining a support surface for supporting the rail end, wherein the bottom wall is removably securable to the rear wall and whereby the bracket is adaptable to selectively provide either a left hand bracket or a right hand bracket.

2. In a fence section including a fence panel extending between upper and lower horizontally extending fence rails with ends of said rails received respectively in upper and lower support brackets secured to spaced upright left and right fence posts for supporting said fence section therebetween;

said brackets each comprised of two spaced upstanding sidewalls receiving the respective fence rail end therebetween, and a rear wall connecting and extending between said sidewalls and a respective one of said posts, whereby said rear wall and side walls define open top and bottom ends for permitting vertical passage of said fence panel;

one of said sidewalls of each bracket hinged to the rear wall for hinging said one sidewall outwardly in the same direction to simultaneously receive a respective one of said fence rail ends into the bracket form the side with said panel extending therebetween whereby said fence panel may be installed and removed from support in said brackets from the side;

at least one aperture in said one sidewall of each bracket for securing it to a respective one of said fence rail ends when received in the bracket with a fastener;

said lower support brackets including a bottom wall in the open bottom ends between the two side walls and defining a support surface for supporting the lower rail ends, wherein said bottom walls of said lower support brackets are removably securable to their respective rear walls and whereby the brackets are adaptable to selectively provide either a left hand bracket or a right hand bracket.

* * * * *